US009046873B2

(12) United States Patent
Kumazawa

(10) Patent No.: US 9,046,873 B2
(45) Date of Patent: Jun. 2, 2015

(54) IMAGE FORMING APPARATUS

(71) Applicant: Kiyomitsu Kumazawa, Nagoya (JP)

(72) Inventor: Kiyomitsu Kumazawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/200,117

(22) Filed: Mar. 7, 2014

(65) Prior Publication Data

US 2014/0286671 A1 Sep. 25, 2014

(30) Foreign Application Priority Data

Mar. 25, 2013 (JP) ..... 2013-062399

(51) Int. Cl.
*G03G 21/20* (2006.01)

(52) U.S. Cl.
CPC ..... *G03G 21/206* (2013.01)

(58) Field of Classification Search
USPC ..... 399/92
See application file for complete search history.

(56) References Cited

FOREIGN PATENT DOCUMENTS

| | | | | |
|---|---|---|---|---|
| JP | H07-20753 A | | 1/1995 | |
| JP | 2002-006697 A | | 1/2002 | |
| JP | 2010-237451 A | * | 10/2010 | ..... G03G 15/02 |
| JP | 2010-237451 A | | 10/2010 | |

* cited by examiner

*Primary Examiner* — Clayton E Laballe
*Assistant Examiner* — Jas Sanghera
(74) *Attorney, Agent, or Firm* — Banner & Witcoff, Ltd.

(57) ABSTRACT

An image forming apparatus including a main duct forming an airflow path of air blown by an air blower such that the air flows through the main duct from a first side to a second side in an extending direction of the airflow path, the main duct including a plurality of air outlets opening in a direction intersecting the extending direction and discretely disposed along the extending direction, and an image forming unit including a plurality of air inlets disposed apart from the plurality of air outlets such that the air flowing out from the plurality of air outlets is introduced into the plurality of air inlets, each air inlet formed such that a second-side end thereof in the extending direction is positionally shifted toward the second side in the extending direction, relative to a second-side end of a corresponding air outlet in the extending direction.

7 Claims, 7 Drawing Sheets

IMAGE FORMING APPARATUS

CROSS-REFERENCE TO RELATED APPLICATION

This application claims priority under 35 U.S.C. §119 from Japanese Patent Application No. 2013-062399 filed on Mar. 25, 2013. The entire subject matter of the application is incorporated herein by reference.

BACKGROUND

1. Technical Field

The following description relates to one or more techniques for an image forming apparatus configured to form an image on a sheet.

2. Related Art

An image forming apparatus has been known that is configured to turn around an airflow direction of air flowing through a duct main body by 90 degrees, so as to introduce the air into an image forming unit.

SUMMARY

In the known image forming apparatus, there is a gap (e.g., a void space) provided between air outlets disposed at the duct main body and air inlets disposed at the image forming unit. Therefore, there might be a case where the air blowing out from the air outlets toward the air inlets is not efficiently introduced into the air inlets.

Aspects of the present invention are advantageous to provide one or more improved techniques, for an image forming apparatus, which make it possible to efficiently introduce, into air inlets, air blowing out from air outlets toward the air inlets.

According to aspects of the present invention, provided is an image forming apparatus configured to form an image on a sheet, the image forming apparatus including an air blower configured to blow air and generate an airflow, a main duct configured to form airflow path of the air blown by the air blower such that the air flows through the main duct from a first side to a second side in an extending direction of the airflow path, the main duct including a plurality of air outlets formed to open in a direction intersecting the extending direction and discretely disposed along the extending direction, and an image forming unit including a plurality of air inlets disposed apart from the plurality of air outlets such that the air flowing out from the plurality of air outlets is introduced into the plurality of air inlets, each air inlet formed such that a second-side end thereof in the extending direction is positionally shifted toward the second side in the extending direction, relative to a second-side end of a corresponding one of the plurality of air outlets in the extending direction.

BRIEF DESCRIPTION OF THE ACCOMPANYING DRAWINGS

Figure 5:
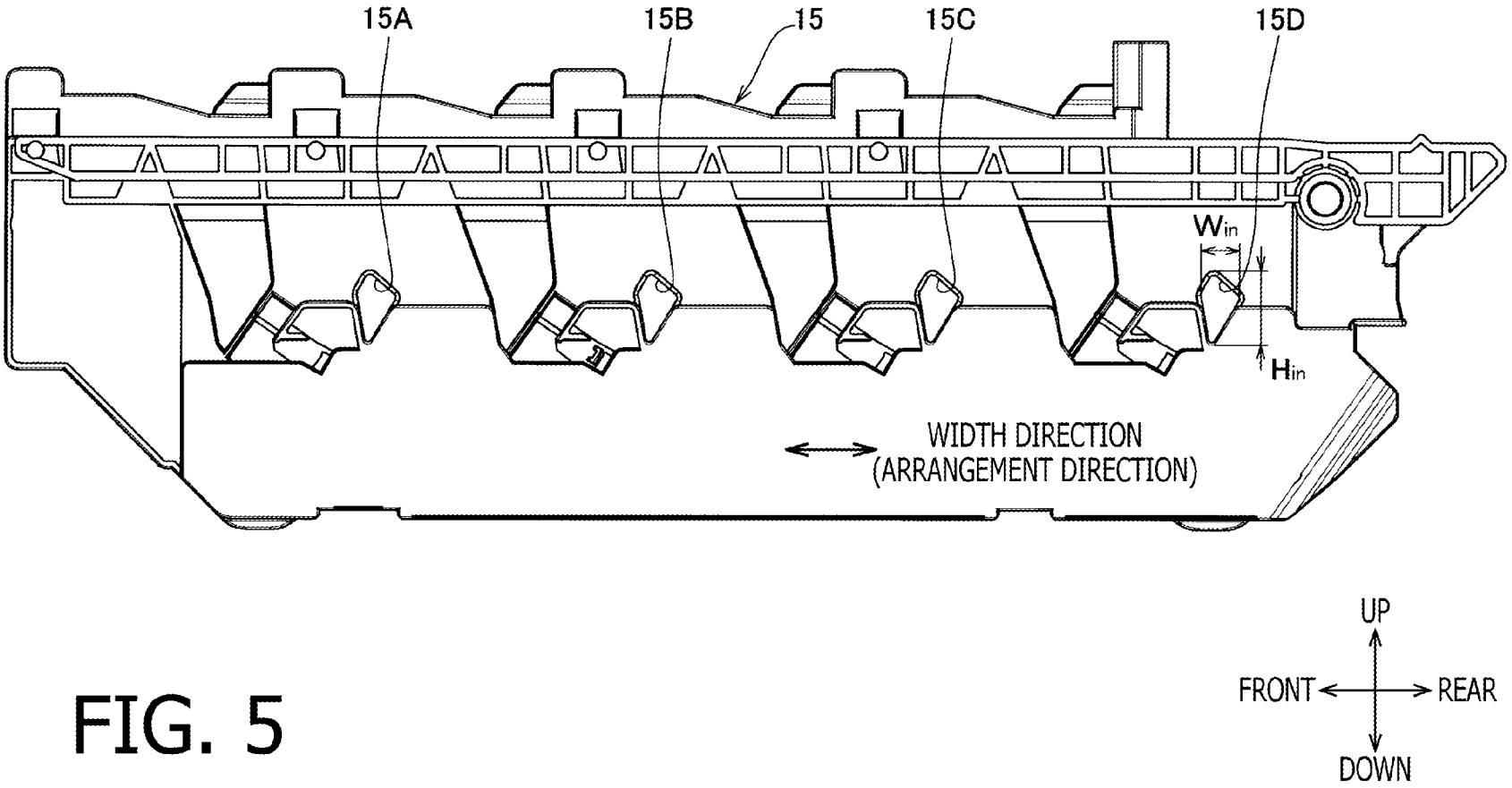

FIG. 5 schematically shows a drawer and air inlets provided at the drawer in the embodiment according to one or more aspects of the present invention.

Figure 6:
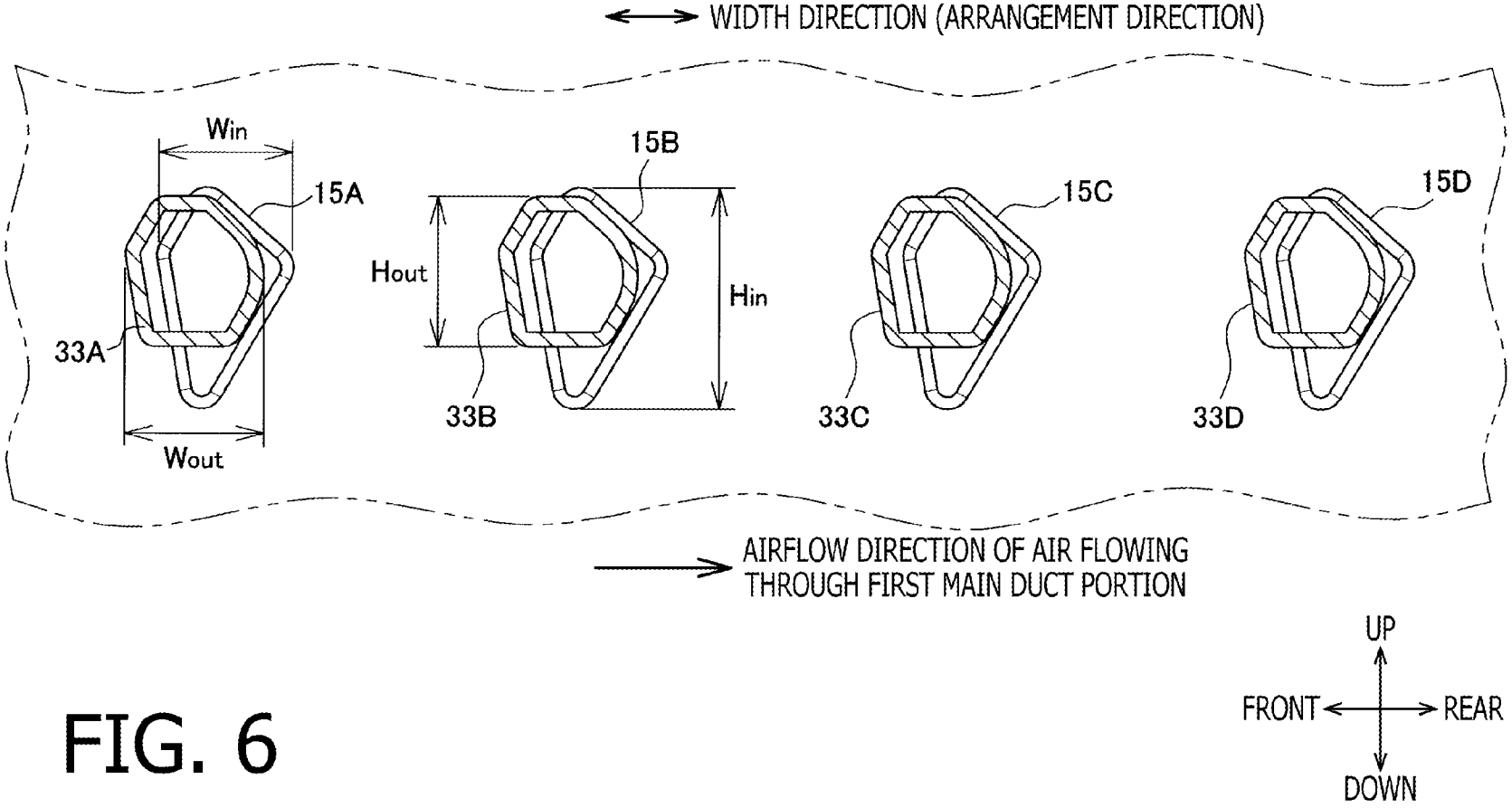

FIG. 6 schematically shows a positional relationship between the air outlets and the air inlets in the embodiment according to one or more aspects of the present invention.

Figure 7:
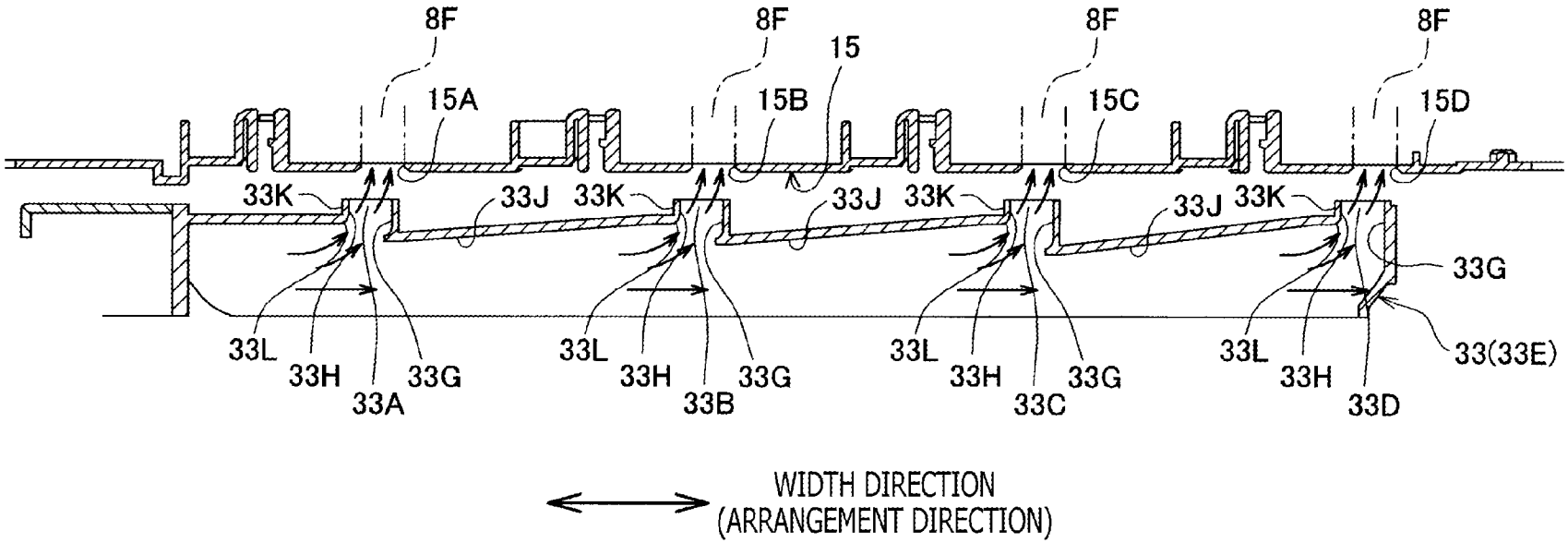

FIG. 7 schematically shows airflow states of air flowing through the main duct, the air outlets, and the air inlets in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompanying drawings. It is noted that, in the embodiment, aspects of the present invention are applied to an image forming apparatus configured to directly transfer a developer image onto a sheet (such as a recording paper) in an electrophotographic method.

It is noted that each arrow, which is shown in the accompanying drawings to indicate a specific direction, is provided for descriptive purposes but not intended to limit the scope of the present invention. Each element to be described at least with a reference character, unless specified otherwise by expressions such as "a plurality of" and "two or more," may be considered as "at least one element."

1. General Configuration of Image Forming Apparatus

Figure 1:
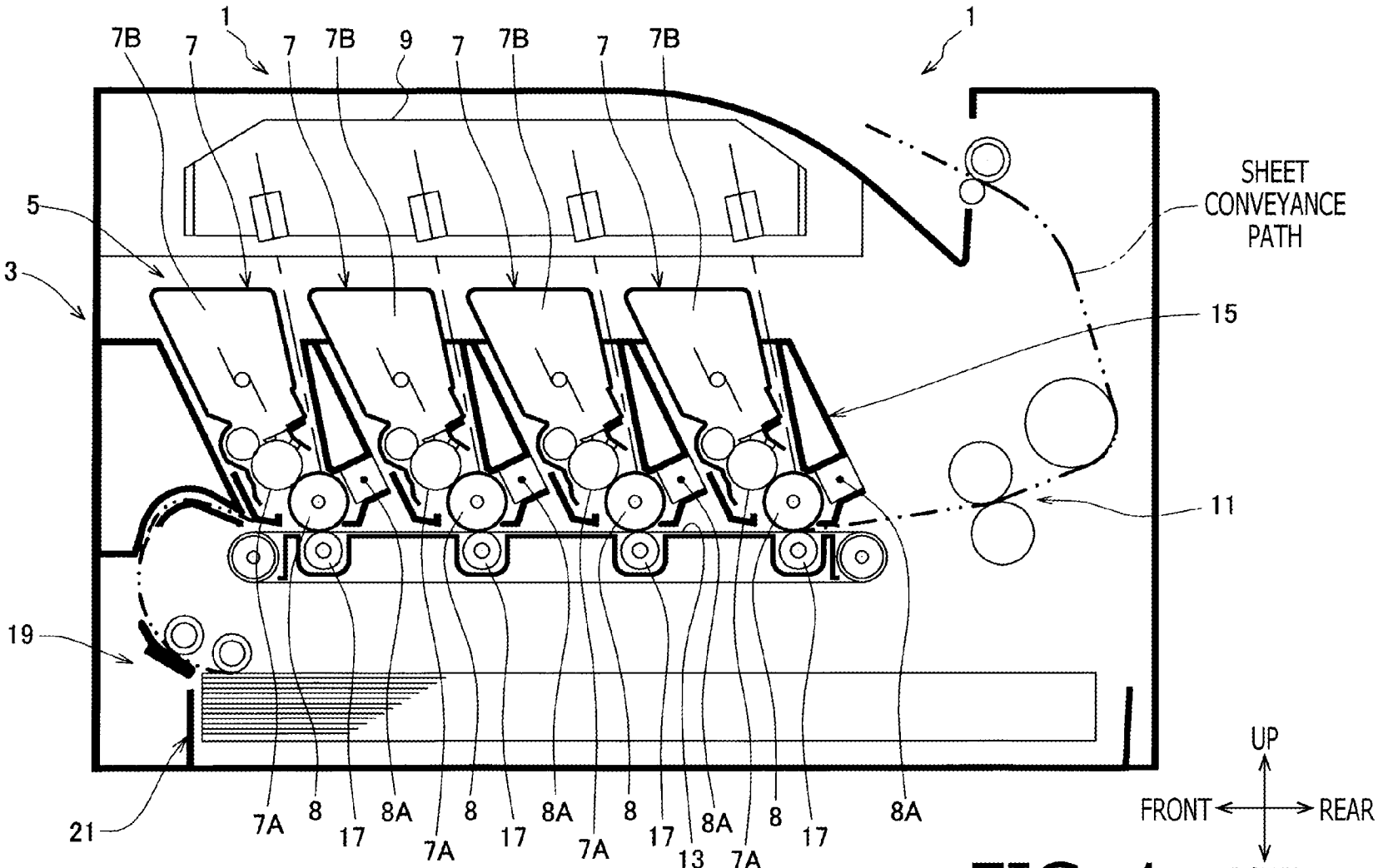
FIG. 1 is a cross-sectional side view schematically showing an internal configuration of an image forming apparatus in an embodiment according to one or more aspects of the present invention.

As shown in FIG. 1, an image forming apparatus 1 includes, in a housing 3 thereof, an image forming unit 5 configured to form an image on a sheet. The image forming unit 5 includes a plurality of development cartridges 7, a plurality of photoconductive drums 8, a plurality of chargers 8A, an exposure unit 9, and a fuser unit 11.

Each development cartridge 7 includes a development roller 7A and a container 7B. The plurality of development cartridges 7 are arranged along a horizontal direction perpendicular to a rotational axis direction of the development rollers 7A.

The arrangement direction along which the development cartridges 7 are arranged is coincident with a front-to-rear direction of the image forming apparatus 1. One side in the arrangement direction is a front side of the image forming apparatus 1. The other side in the arrangement direction is a rear side of the image forming apparatus 1. The development cartridges 7 for respective different colors of development agent are arranged in an order of yellow, magenta, cyan, and black from the one side to the other side in the arrangement direction.

Each photoconductive drum 8 is configured to carry a developer image. Each charger 8A is configured to charge a corresponding photoconductive drum 8. The exposure unit 9 is configured to expose the charged photoconductive drums 8 and form an electrostatic latent image on each photoconductive drum 8. Each development roller 7A is configured to supply a corresponding photoconductive drum 8 with development agent stored in a corresponding container 7B, and form a developer image corresponding to the electrostatic latent image.

Each development cartridge 7 is detachably attached to a box-shaped drawer 15. Namely, the drawer 15, together with elements attached thereto (such as the plurality of development cartridges 7, the plurality of photoconductive drums 8, and the plurality of chargers 8A), forms the image forming unit 5.

The drawer 15 is attached to an apparatus main body to be movable relative to the apparatus main body. The apparatus main body represents an undetachable or unreplaceable portion including two main frames 30 shown in FIG. 2. The two main frames 30 are disposed to face each other across the image forming unit 5 including the drawer 15. Each of the main frames 30 is a reinforcing member formed substantially in a plate shape.

A moving direction of the drawer 15 is the horizontal direction parallel to the arrangement direction. When the drawer 15 is drawn forward from the apparatus main body, each development cartridge 7 is placed into a state detachable from the drawer 15 and the apparatus main body.

Therefore, when moving the drawer 15 such that the drawer 15 is drawn from the apparatus main body, a user is allowed to temporarily move the plurality of development cartridges 7 relative to the apparatus main body and detach each development cartridge 7 individually from the drawer 15.

Each photoconductive drum 8 is not integrated with a corresponding development cartridge 7. Further, each charger 8A is not integrated with a corresponding development cartridge 7. Hence, when a development cartridge 7 is removed from the drawer 15, a corresponding photoconductive drum 8 and a corresponding charger 8A remain attached to the drawer 15.

As shown in FIG. 1, a belt 13 is configured to convey a sheet. A surface (hereinafter, which may be referred to as a transfer surface) of the belt 13 that faces the photoconductive drums 8 is configured to move from the one side to the other side in the arrangement direction. The sheet is electrostatically attracted by the transfer surface of the belt 13. Therefore, the sheet is conveyed from the one side to the other side in the arrangement direction, with the movement of the belt 13.

There are transfer bodies 17 each disposed in a position to face a corresponding photoconductive drum 8 across the transfer surface of the belt 13. Each transfer body 17 is configured to transfer onto the sheet the developer image carried on a corresponding photoconductive drum 8. Therefore, the developer images carried on the photoconductive drums 8 are transferred onto the sheet in a superimposed manner.

A feeding mechanism 19 is configured to feed sheets placed on a feed tray 21 toward the image forming unit 5 on a sheet-by-sheet basis. The feed tray 21 is configured to hold the sheets, placed thereon, onto which images are to be formed. The feed tray 21 is detachably attached to the apparatus main body.

2. Configuration for Blowing Air to Image Forming Unit (Particularly, to Chargers)

Figure 3:
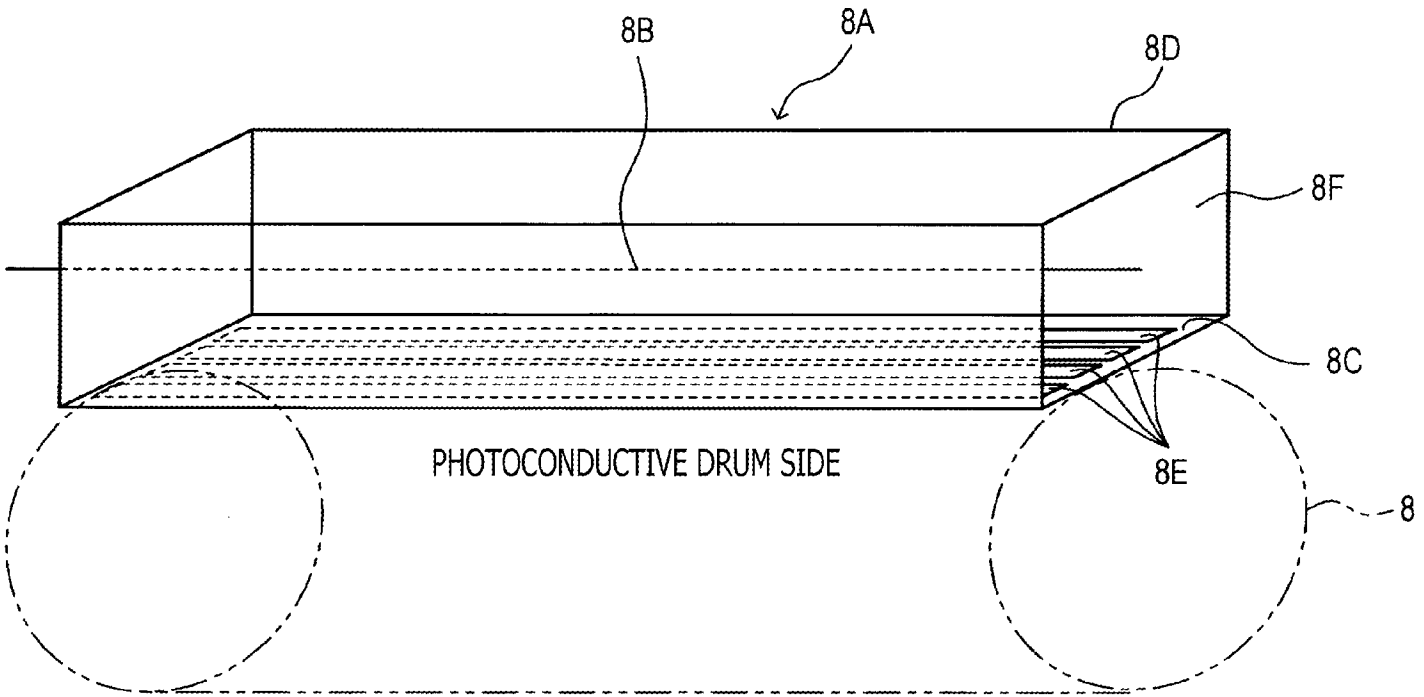
FIG. 3 is a perspective view schematically showing a charger and a photoconductive drum of the image forming apparatus in the embodiment according to one or more aspects of the present invention.

As shown in FIG. 3, each charger 8A is a scorotron charger that includes a charging wire 8B and a grid electrode 8C. The charging wire 8B extends in a direction parallel to the rotational axes of the photoconductive drums 8. A casing 8D is a rectangular-tube-shaped member extending parallel to the charging wire 8B. The casing 8D is configured to surround and cover the charging wire 8B.

The grid electrode 8C is disposed on a side closer to the photoconductive drum 8 than the charging wire 8B and a gap (which exists between the charging wire 8B and the grid electrode 8C). The grid electrode 8C is formed in a band plate shape extending parallel to the charging wire 8B. The grid electrode 8C includes rectangular-hole-shaped slits 8E extending parallel to the charging wire 8B.

The slits 8E are configured such that an inside of the casing 8D communicate with an outside of the casing 8D on a side of the photoconductive drum 8. Each charger 8A is configured to control an electric potential difference between the charging wire 8B and the grid electrode 8C such that corona discharge is generated from the charging wire 8B, and to charge a corresponding photoconductive drum 8.

Figure 2:
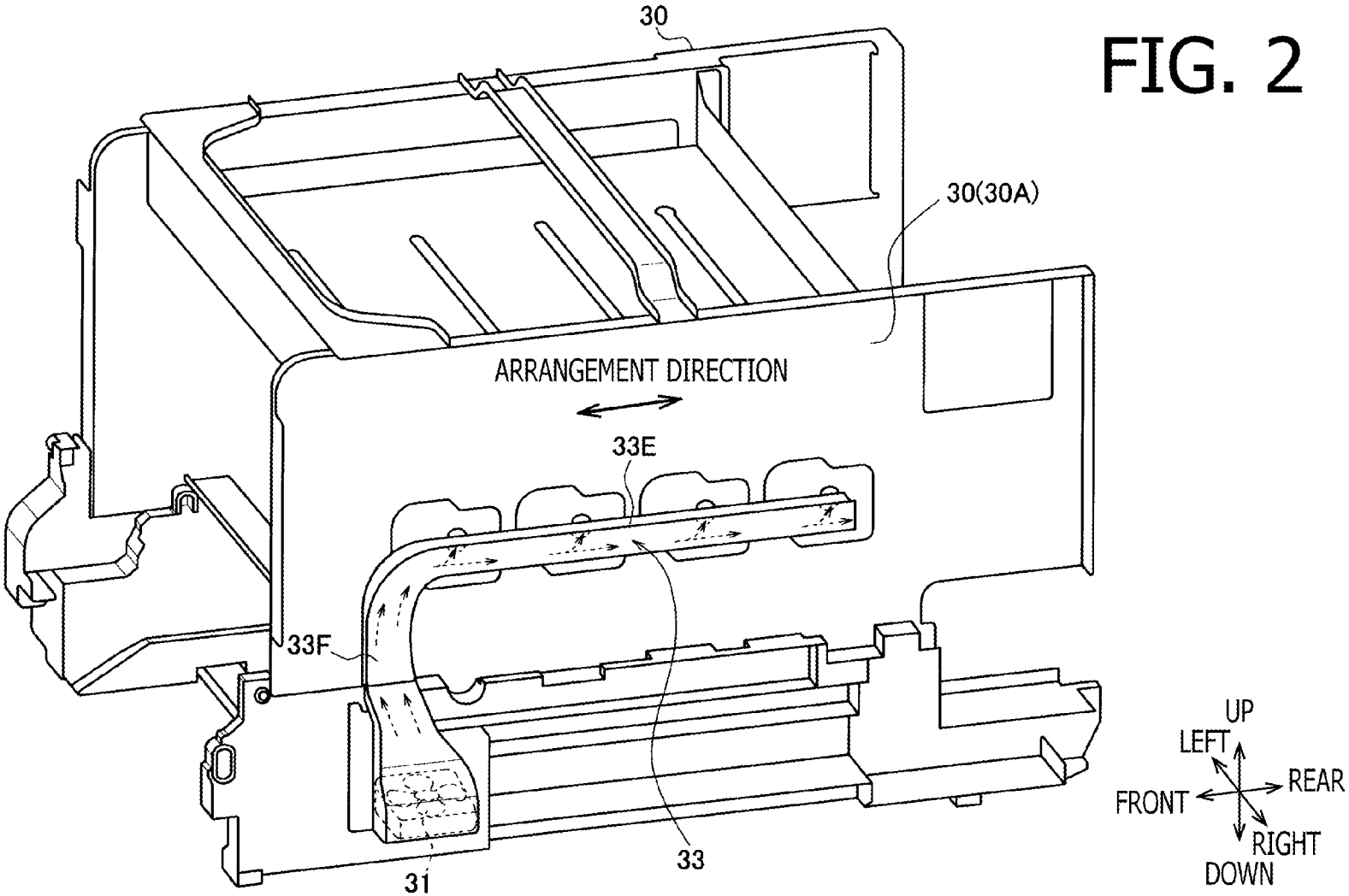
FIG. 2 is a perspective view schematically showing main frames and a main duct of the image forming apparatus in the embodiment according to one or more aspects of the present invention.

One end (in FIG. 3, a left end) of the casing 8D in its longitudinal direction is closed. At the other end (in FIG. 3, a right end) of the casing 8D in the longitudinal direction, an opening 8F is provided. The opening 8F is configured to let air flow into the casing 8D therethrough. As shown in FIG. 5, at portions of the drawer 15 that face the openings 8F, respectively, air inlets 15A, 15B, 15C, and 15D are disposed. The air inlets 15A, 15B, 15C, and 15D are configured to let air flow therethrough As shown in FIG. 2, an air blower 31 is disposed at one of the two main frames 30 that faces the air inlets 15A to 15D. The air blower 31, which is configured to blow air and generate airflow, includes an axial-flow fan and an electrical motor (not shown) for rotating the axial-flow fan.

A main duct 33 is configured to form an airflow path of the air blown by the air blower 31. The main duct 33 includes a first main duct portion 33E, and a second main duct portion 33F. The first main duct portion 33E extends parallel to the arrangement direction. The second main duct portion 33F extends toward the air blower 31 from one end of the first main duct portion 33E in an extending direction of the first main duct portion 33E.

Figure 4B:
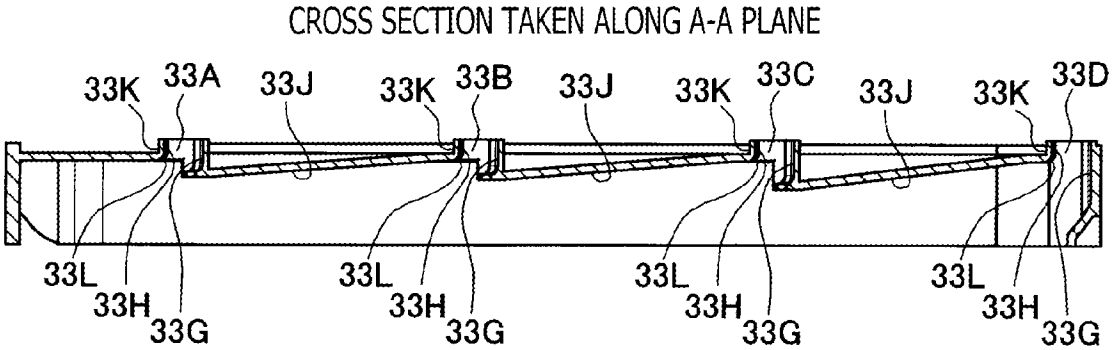
FIG. 4B is a cross-sectional view of the main duct taken along an A-A plane shown in FIG. 4A in the embodiment according to one or more aspects of the present invention.
Figure 4A:
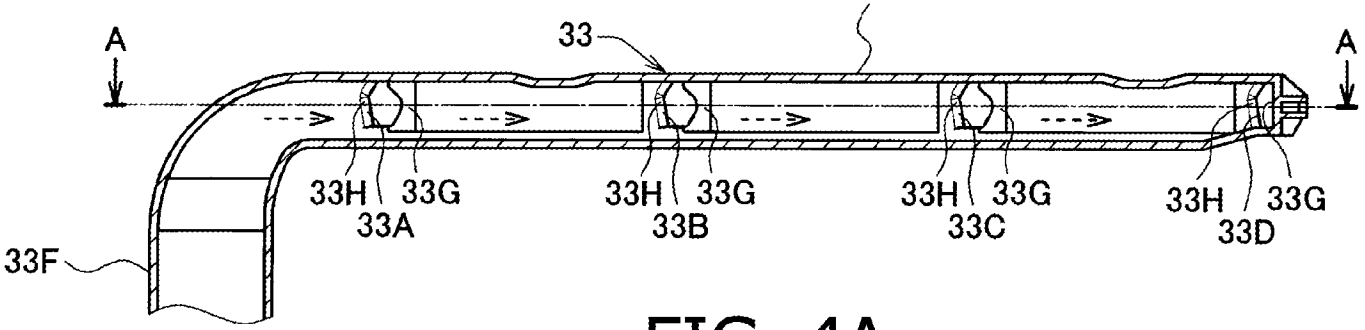
FIG. 4A is a cross-sectional side view schematically showing the main duct in the embodiment according to one or more aspects of the present invention.

As shown in FIGS. 4A and 4B, the first main duct portion 33E includes a plurality of air outlets 33A, 33B, 33C, and 33D opening in a direction perpendicular to an extending direction of the first main duct portion 33E. The plurality of air outlets 33A to 33D are discretely disposed, along the extending direction of the first main duct portion 33E, in positions corresponding to the air inlets 15A to 15D, respectively, as shown in FIG. 6.

When the drawer 15 is attached to the apparatus main body, as shown in FIG. 7, the air outlets 33A to 33D are spaced apart from the air inlets 15A to 15D via a gap (e.g., a void space), respectively. Air, blowing out from the air outlets 33A to 33D, is introduced into the chargers 8A via the air inlets 15A to 15D corresponding to the air outlets 33A to 33D, respectively.

Hereinafter, the aforementioned extending direction of the first main duct portion 33E, i.e., a direction parallel to the arrangement direction may be referred to as a "width direction." As shown in FIG. 7, the air flowing through the first main duct portion 33E goes from one end (first side) to the other end (second side) in the width direction. Accordingly, in the first main duct portion 33E, the first side in the width direction corresponds to an upstream side in an airflow direction, and the second side in the width direction corresponds to a downstream side in the airflow direction. It is noted that the first side in the width direction is the left side in FIG. 7, and the second side in the width direction is the right side in FIG. 7.

Further, as shown in FIG. 6, second-side ends (right-side ends in the figure) of the air inlets 15A to 15D in the width direction are positionally shifted toward the second side in the width direction (rightward in the figure), relative to first-side ends (left-side ends in the figure) of the air outlets 33A to 33D in the width direction, respectively.

Namely, when a user views the air inlets 15A to 15D from a side of the air outlets 33A to 33D, the right-side ends of the air inlets 15A to 15D are positionally shifted downstream in the airflow direction (of the air flowing through the first main duct portion 33E), relative to the right-side ends of the air outlets 33A to 33D, respectively. It is noted that, hereinafter, a downstream side in the airflow direction of the air flowing through the first main duct portion 33E may be simply referred to as a "downstream side." Likewise, an upstream side in the airflow direction of the air flowing through the first main duct portion 33E may be simply referred to as an "upstream side."

A maximum dimension Win of each air inlet 15A to 15D in the width direction is larger than a maximum dimension Wout of each air outlet 33A to 33D in the width direction. A maximum dimension Hin of each air inlet 15A to 15D in a direction perpendicular to the width direction is larger than a maximum dimension Hout of each air outlet 33A to 33D in the direction perpendicular to the width direction.

In the embodiment, all the air inlets 15A to 15D have the same shape, and the maximum dimensions Win and Hin are applicable in common to all the air inlets 15A to 15D. Further, all the air outlets 33A to 33D have the same shape, and the maximum dimensions Wout and Hout are applicable in common to all the air outlets 33A to 33D.

Figure 4C:
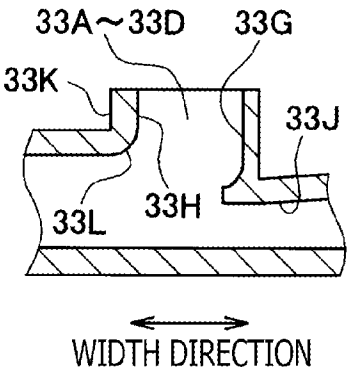
FIG. 4C is an enlarged view showing an air outlet of the main duct in the embodiment according to one or more aspects of the present invention.

As shown in FIG. 4C, there is a downstream side wall 33G disposed at the second-side end (i.e., at the downstream end) of each air outlet 33A to 33D. The downstream side wall 33G protrudes toward an inside of the first main duct portion 33E from each air outlet 33A to 33D.

The downstream side wall 33G, disposed at the second-side end of each air outlet 33A to 33D in the width direction, protrudes more than an upstream wall 33H disposed at the first-side end of each air outlet 33A to 33D in the width direction. Thus, each downstream side wall 33G serves as an introducing wall to introduce the air, flowing through the first main duct portion 33E, into a corresponding one of the air outlets 33A to 33D. Further, as shown in FIG. 4B, each downstream side wall 33G includes a slanted surface 33J extending from a distal end of the downstream side wall 33G toward the second side in the width direction (i.e., toward the downstream side in the airflow direction).

Each slanted surface 33J is slanted in such a direction as to become closer to a base end of a downstream side wall 33G adjacent on the second side in the width direction, toward the second side in the width direction (i.e., toward the downstream side in the airflow direction). A downstream end of each slanted surface 33J is smoothly connected with a corresponding upstream wall 33H adjacent on the downstream side of the downstream end of each slanted surface 33J.

As shown in FIG. 4C, the first main duct portion 33E includes sub ducts 33K that protrude from the air outlets 33A to 33D toward the air inlets 15A to 15D, respectively. A protruding direction of the sub ducts 33K is a direction perpendicular to the extending direction of the first main duct portion 33E, i.e., is a direction perpendicular to the width direction.

In addition, there is a curved portion 33L disposed at a first-side end of a base end of each sub duct 33K in the width direction, i.e., at an upstream end of a portion connecting each sub duct 33K with the first main duct portion 33E. Each curved portion 33L is formed to be convex toward an inside of a corresponding sub duct 33K.

3. Features of Image Forming Apparatus in Embodiment

As shown in FIG. 7, (at least a part of) the flow of the air blowing out from the air outlets 33A to 33D fails to negotiate a turn in a direction intersecting the width direction (i.e., in a direction intersecting the extending direction of the first main duct portion 33E). Thus, (at least a part of) the air blowing out from the air outlets 33A to 33D is ejected from the air outlets 33A to 33D with an angle relative to the direction perpendicular to the width direction and with a velocity component in the width direction.

Accordingly, when the second-side end of each air inlet 15A to 15D is positionally shifted toward the second side in the width direction, relative to the second-side end of a corresponding one of the air outlets 33A to 33D, it is possible to efficiently let in, via the air inlets 15A to 15D, air ejected with a velocity component in the width direction, of the air blowing out from the air outlets 33A to 33D.

Namely, in the embodiment, the air blowing out from the air outlets 33A to 33D is directed toward the air inlets 15A to 15D. Accordingly, it is possible to efficiently let the air blowing out from the air outlets 33A to 33D, flow into the air inlets 15A to 15D.

In the embodiment, the maximum dimension Win of each air inlets 15A to 15D in the width direction is larger than the maximum dimension Wout of each air outlets 33A to 33D in the width direction. Thereby, it is possible to certainly let the air blowing out from the air outlets 33A to 33D, flow into the air inlets 15A to 15D.

In the embodiment, the downstream side wall 33G, which is disposed at the second-side end of each air outlet 33A to 33D in the width direction, protrudes from each air outlet 33A to 33D toward the inside of the first main duct portion 33E. Further, the downstream side wall 33G protrudes more than the upstream wall 33H disposed at the first-side end of each air outlet 33A to 33D in the width direction. Thereby, it is possible to certainly introduce the air flowing through the first main duct portion 33E, into the air outlets 33A to 33D.

In the embodiment, each slanted surface 33J, which extends from the distal end of a corresponding downstream side wall 33G toward the second side in the width direction, is slanted in such a direction as to become closer to the base end of a second-side adjacent downstream side walls 33G toward the downstream side (in the airflow direction).

Thereby, in the embodiment, it is possible to prevent a separation vortex, which might disturb the air flowing through the first main duct portion 33E, from being generated behind any downstream side wall 33G. Accordingly, it is possible to prevent generation of a disturbance of the airflow, and to efficiently introduce the air into the air outlets 33A to 33D.

In the embodiment, the curved portions 33L, each of which protrudes toward the inside of a corresponding sub duct 33K, are disposed at the first-side ends of the base ends of the sub ducts 33K in the width direction, respectively. Thereby, it is possible to prevent a separation vortex from being generated on a side of the base end of any sub duct 33K. Thus, it is possible to prevent reduction in the efficiency for introducing the air into the air outlets 33A to 33D.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations of the same configurations as exemplified in the aforementioned embodiments will be omitted.

[Modifications]

In the aforementioned embodiment, the casing 8D of each charger 8A is formed in a rectangular tube shape. Nonetheless, the casing 8D may be formed in other shapes such as a cylindrical shape.

In the aforementioned embodiment, the air outlets 33A to 33D open in the direction perpendicular to the extending direction of the first main duct portion 33E. Nonetheless, each air outlet 33A to 33D only needs to open in a direction intersecting the extending direction of the first main duct portion 33E.

In the aforementioned embodiment, the maximum dimension Win of the air inlets 15A to 15D in the width direction is larger than the maximum dimension Wout of the air outlets 33A to 33D in the width direction. Nonetheless, the present invention is not limited to such a configuration.

In the aforementioned embodiment, each downstream side wall 33G protrudes more than the upstream wall 33H disposed at the first-side end of each air outlet 33A to 33D in the width direction. Nonetheless, the present invention is not limited to such a configuration.

In the aforementioned embodiment, each downstream side wall 33G includes the slanted surface 33J extending from the distal end of the downstream side wall 33G toward the second side in the width direction. Nonetheless, the present invention is not limited to such a configuration. For instance, the first main duct portion 33E may be configured without the slanted surfaces 33J.

In the aforementioned embodiment, the air inlets 15A to 15D are configured to introduce the air into the chargers 8A. Nonetheless, the present invention is not limited to such a configuration. the air inlets 15A to 15D may be applied to a configuration for introducing the air into elements included in the image forming unit 5 other than the chargers 8A.

In the aforementioned embodiment, the air blower 31 includes the axial-flow fan. Nonetheless, the present invention is not limited to such a configuration. For instance, the air blower 31 may include a centrifugal fan instead of the axial-flow fan.

What is claimed is:

1. An image forming apparatus configured to form an image on a sheet, comprising:

an air blower configured to blow air and generate airflow;

a main duct configured to form an airflow path of the air blown by the air blower such that the air flows through the main duct from a first side to a second side in an extending direction of the airflow path, the main duct comprising a plurality of air outlets formed to open in a direction intersecting the extending direction and discretely disposed along the extending direction; and an image forming unit comprising a plurality of air inlets disposed apart from the plurality of air outlets such that the air flowing out from the plurality of air outlets is introduced into the plurality of air inlets, each air inlet formed such that a second-side end thereof in the extending direction is positionally shifted toward the second side in the extending direction, relative to a second-side end of a corresponding one of the plurality of air outlets in the extending direction, wherein the main duct comprises:

a second-side wall disposed at the second-side end of each air outlet in the extending direction, each second-side wall protruding more toward an inside of the main duct from a corresponding air outlet, than a first-side wall disposed at a first-side end of each air outlet in the extending direction, and a slanted surface extending from a distal end of each second-side wall toward the second side in the extending direction, each slanted surface being slanted in such a direction as to become closer to a base end of a second-side wall adjacent on the second side in the extending direction, toward the second side in the extending direction.

2. The image forming apparatus according to claim 1, wherein a maximum dimension of each air inlet in the extending direction is larger than a maximum dimension of each air outlet in the extending direction.

3. The image forming apparatus according to claim 1, wherein the main duct comprises a sub duct protruding from each air outlet toward a corresponding air inlet in a protruding direction perpendicular to the extending direction.

4. The image forming apparatus according to claim 3, wherein each sub duct comprises a curved portion disposed at a first-side end of a base end of the sub duct in the extending direction, each curved portion formed to be convex toward an inside of a corresponding sub duct.

5. The image forming apparatus according to claim 1, wherein the image forming unit comprises:

a plurality of photoconductive drums each configured to carry a developer image; and a plurality of chargers configured to charge the plurality of photoconductive drums, respectively, the plurality of chargers comprising the plurality of air inlets, respectively.

6. An image forming apparatus configured to form an image on a sheet, comprising:

an air blower configured to blow air and generate airflow;

a main duct configured to form an airflow path of the air blown by the air blower such that the air flows through the main duct from a first side to a second side in an extending direction of the airflow path, the main duct comprising a plurality of air outlets formed to open in a direction intersecting the extending direction and discretely disposed along the extending direction; and an image forming unit comprising a plurality of air inlets disposed apart from the plurality of air outlets such that the air flowing out from the plurality of air outlets is introduced into the plurality of air inlets, each air inlet formed such that a second-side end thereof in the extending direction is positionally shifted toward the second side in the extending direction, relative to a second-side end of a corresponding one of the plurality of air outlets in the extending direction, wherein the main duct further comprises:

a second-side wall disposed at the second-side end of each air outlet in the extending direction; and a slanted surface extending from a distal end of each second-side wall toward the second side in the extending direction, each slanted surface being slanted in such a direction as to become closer to a base end of a second-side wall adjacent on the second side in the extending direction, toward the second side in the extending direction.

7. An image forming apparatus configured to form an image on a sheet, comprising:

an air blower configured to blow air and generate airflow;

a main duct configured to form an airflow path of the air blown by the air blower such that the air flows through the main duct from a first side to a second side in an extending direction of the airflow path, the main duct comprising a plurality of air outlets formed to open in a direction intersecting the extending direction and discretely disposed along the extending direction; and an image forming unit comprising a plurality of air inlets disposed apart from the plurality of air outlets such that the air flowing out from the plurality of air outlets is introduced into the plurality of air inlets, each air inlet formed such that a second-side end thereof in the extending direction is positionally shifted toward the second side in the extending direction, relative to a second-side end of a corresponding one of the plurality of air outlets in the extending direction and that a first-side end thereof in the extending direction is positionally shifted toward the second side in the extending direction, relative to a first-side end of the corresponding one of the plurality of air outlets in the extending direction.

* * * * *